US006082914A

United States Patent [19]

Barrus et al.

[11] Patent Number: 6,082,914

[45] Date of Patent: Jul. 4, 2000

[54] THERMAL PRINTER AND DRIVE SYSTEM FOR CONTROLLING PRINT RIBBON VELOCITY AND TENSION

[75] Inventors: Gordon B. Barrus, San Juan Capistrano; Kevin P. Moore, Anaheim, both of Calif.

[73] Assignee: Printronix, Inc., Irvine, Calif.

[21] Appl. No.: 09/323,169

[22] Filed: May 27, 1999

[51] Int. Cl.[7] ..... B41J 33/22; B41J 33/36

[52] U.S. Cl. ..... 400/234; 400/223; 400/225; 400/232

[58] Field of Search ..... 400/234, 223, 400/225, 232, 120.01, 611, 613

[56] References Cited

U.S. PATENT DOCUMENTS 5,366,303 11/1994 Barrus et al. ..... 400/239
5,490,638 2/1996 Driftmyer et al. ..... 242/421
5,634,731 6/1997 Kita et al. ..... 400/249
5,820,277 10/1998 Schulte ..... 400/225

*Primary Examiner*—John S. Hilten
*Assistant Examiner*—Daniel J. Colilla
*Attorney, Agent, or Firm*—George F. Bethel

[57] ABSTRACT

A thermal printer having a supply of media with a rotatable platen on which the media is moved for printing by a thermal printing head. A supply spindle supplies print ribbon from a supply spool mounted thereon, and a take-up spindle takes up the used print ribbon on a take-up spool. The spindles are each driven by a motor and controlled by a controller which detects the Back EMF (BEMF) of the motors, and calculates the velocity of the spindles, spool, and print ribbon to control each motor based on the BEMF. The status of the print ribbon as to low condition, breaks, ribbon full and other monitoring functions can be provided to a remote host computer or other monitoring station.

41 Claims, 6 Drawing Sheets

THERMAL PRINTER AND DRIVE SYSTEM FOR CONTROLLING PRINT RIBBON VELOCITY AND TENSION

BACKGROUND OF THE INVENTION

1. Field of the Invention

This invention relates to printers which place a series of dots on underlying media to form a pattern, alpha numeric symbols, or a bar code. It relates more to those types of printers which are thermal printers wherein a print ribbon having a wax or other displaceable material thereon can be heated and disposed on an underlying media for printing thereon. Such underlying media can comprise paper, plastic, a web supporting a plurality of labels, or other media. The invention specifically relates to the print ribbon being driven and matched to the underlying media in a consistent manner to avoid various printing inconsistencies. Such printing inconsistencies can be light or dark print, improper alpha numeric symbols, or fuzzy printing as well as bar codes having either unclear or improper separations.

2. Description of the Prior Art

The prior art of thermal printers relied upon various brakes, clutches and other apparatus in order to provide for the proper control of the print ribbon. The print ribbon has material thereon such as a wax or other type of heat sensitive material which can be used to imprint underlying media. The print ribbon has a very flexible and thin consistency. It borders on the fineness of a film like material of a flexible plastic sheet.

Disposed on the print ribbon is the print substance which must be disposed on underlying media. The substance of the print ribbon which is disposed under heated conditions is placed on the underlying media. It is placed at discrete points that must be accurately maintained. The accuracy is with regard to alpha numeric representations and particularly with regard to bar codes which have to be properly read.

During the process of displacement of the substance from the print ribbon, a heating element is used. The heating element can be an elongated bar having very discrete heating elements that conform to a certain number of dots per inch as desired. Such dots per inch in the way of heating elements can range upwards of 600 dots per inch and more.

The print ribbon when passing under the heating element and on top of an underlying media is subject to wrinkling, striations, displacement, stretching, and other distortions. This is caused by tension, inertia, and other elements in the drive systems. In the past, it has been customary to compensate for these distortions with various clutches, controls, and mechanical elements which although workable in some cases do not always provide the best results.

Further complicating this matter is the fact that the underlying media that is to be printed on must be driven over a platen which is a rotatable platen formed of a hardened elastomeric material against which the print ribbon is guided and heated by the heating elements of the print head. Oftentimes, the print ribbons become mis-matched with the underlying media, and distortions occur which can be quite severe in a bar code are encountered.

In order to overcome the foregoing deficiencies, this invention utilizes a positive drive system of the print ribbon with respect to the underlying media. This is accomplished by means of a pair of D.C. motors that drive the take-up and supply spools.

The motors are driven by a current control drive circuit which is controlled by rotation of the motors. The motor velocities are measured by circuits that measure the Back EMF (BEMF) voltage of the motor drives. The tension on the print ribbon can then be a function of the spool radius and the motor torque, as well as inertia and other dynamic aspects including the mass of the rolls on both the take-up and supply spools.

The media is driven by a stepper motor connected to a stepper motor drive through an electrical circuit that applies power to the stepper motor.

An important feature of this invention over the prior art is the fact that it maintains the media stepper motor driver in a consistent manner with the passage of the print ribbon.

Another object of this invention is the control of the tension on the print ribbon. It is particularly important as it passes through the print head and over the underlying media that is to be printed. This particular control of the print ribbon is enhanced by the measurement of the velocity and other aspects of the print ribbon feed motor and take-up motor respectively.

The foregoing control is effected by BEMF sensors that are connected to the respective D.C. motors for the take-up and the drive spindles on which the ribbon spools are connected.

The BEMF sensors of the respective D.C. motors do not require any additional cabling. Fundamentally, the BEMF is measured across the motor windings. Since there is a cable that already runs from the motor windings to the controller, this cable is used for sensing as well as driving the motor.

Other aspects of the prior art have utilized various sensors to mount several of them at various locations to sense the movement of the print ribbon, and then run independent cabling to them to achieve the same result as using the BEMF sensors of the motors.

A further enhancement is that the ribbon tension can be varied with differently sized ribbon width. The prior art as previously stated to the contrary uses mechanical tension devices to maintain the tension on the print ribbon. Such mechanical tension devices can't vary the ribbon tension with respect to the ribbon width or the spool diameter. An object of this invention is to avoid the foregoing deficiencies by varying the tension to accommodate such changes thereby substantially lessening print ribbon wrinkle.

Another object of this invention is to provide a low or out ribbon indicator which can be added without having to add any other sensors. Fundamentally, since the method used to control the ribbon requires calculating the supply spool radius, the detection of the ribbon being low or out can be added without the need for additional hardware.

A full take-up spool indicator is also utilized without having to add additional sensors. This is based upon the fact that the method used to control the ribbon requires calculating the take-up spool radius. Thereby without adding additional hardware, determination of the take-up spool being filled can be accomplished.

Another object of this invention is that it provides for tensioning with a backing up tension device. When mechanical devices are used to maintain tension, especially friction type devices, another mechanism needs to be added to maintain the tension. This is usually a spring wrapped around a cam. This invention removes the need for this additional mechanism.

A further object of this invention is that when the media is jammed, there need not be any additional detectors. This is based upon the fact that the reading with respect to the overall movement of the media is detected by the invention so that a jam can be easily sensed and detected.

SUMMARY OF THE INVENTION

In summation, this invention is a thermal printer and control system having a positive print ribbon drive and take-up by means of D.C. motors that have the Back EMF (BEMF) measured for purposes of calculating the amount of ribbon on each respective spool as well as incorporating that into the velocity that should be applied to the movement of the print ribbon with respect to necessary torque as well as calculating the respective mass of the print ribbon rolls and controlling it with regard to the underlying media.

More specifically, the invention incorporates utilization of controls for a print ribbon with respect to an underlying media that is to be thermally printed. The controls utilize a D.C. motor for the take-up spool and a D.C. motor for the supply spool. These respective D.C. motors are such wherein their windings are connected to a drive circuit. The output of the windings as to the BEMF can be utilized to measure the velocity of the respective take-up and supply spools connected to and driven by the D.C. motors.

The BEMF is then utilized to calculate the speed of the spools. Knowing this, the applicable tension on the ribbon can then be calculated or established as being a function of the spool radius, spool mass and inertia, and the required motor torque based upon the respective velocity.

A calculation is utilized that takes into consideration the mass and inertia of the respective rolls or spools and the mass and inertia of the drive train to accomplish proper tensioning through torque that is applied by the D.C. motors.

The foregoing controls are incorporated into a computer chip or ASIC. The controls can also utilize an ongoing calculation or utilize a look-up table. Controls can then be established for movement of the print ribbon and cooperatively with the media stepper motor to drive the media that is to be printed upon.

From the foregoing, it can be seen that a substantial coordinated driving of the print ribbon and media can be accomplished. The net result is an improved relationship of the print ribbon to the print media for avoidance of various inconsistencies in printing as it passes over the print head and the platen.

DESCRIPTION OF THE PREFERRED EMBODIMENTS

Figure 1:
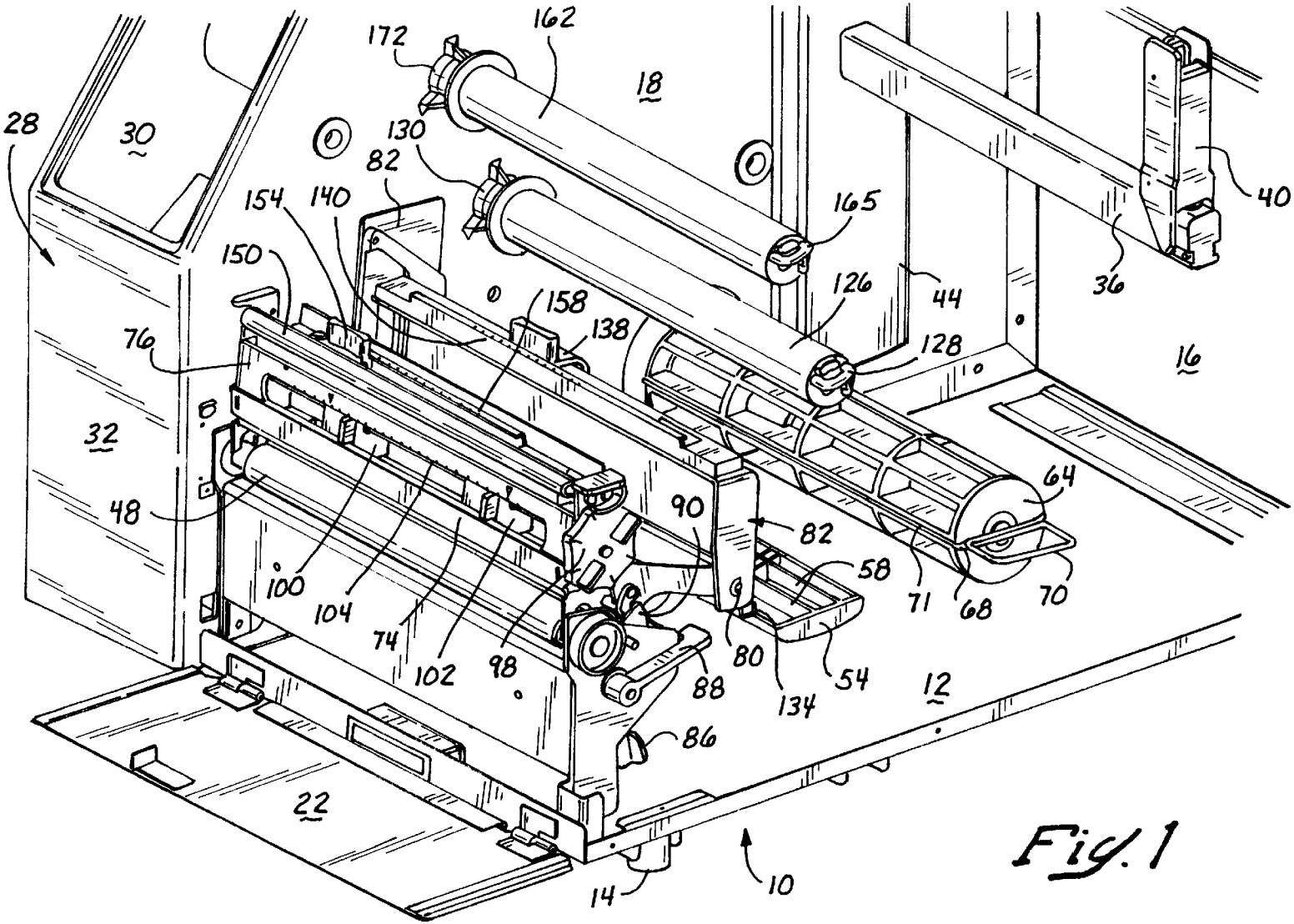
FIG. 1 shows a perspective view of the drive and take-up spools of this invention incorporated with a thermal print head and media handling system.
Figure 2:
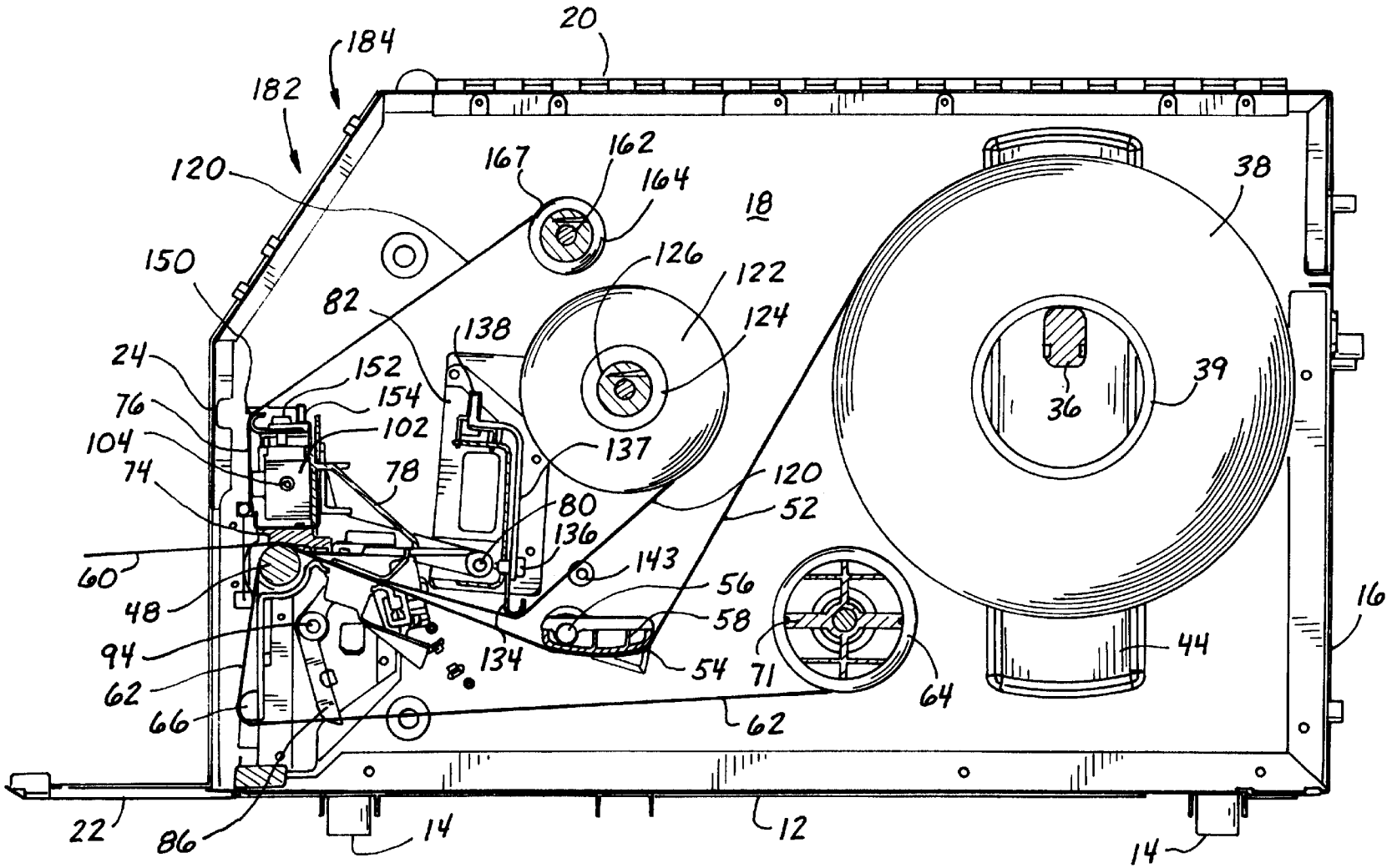
FIG. 2 shows a side elevation view of the media and print ribbon path as well as spools of the media and print ribbon itself as it moves over the print head.
Figure 3:
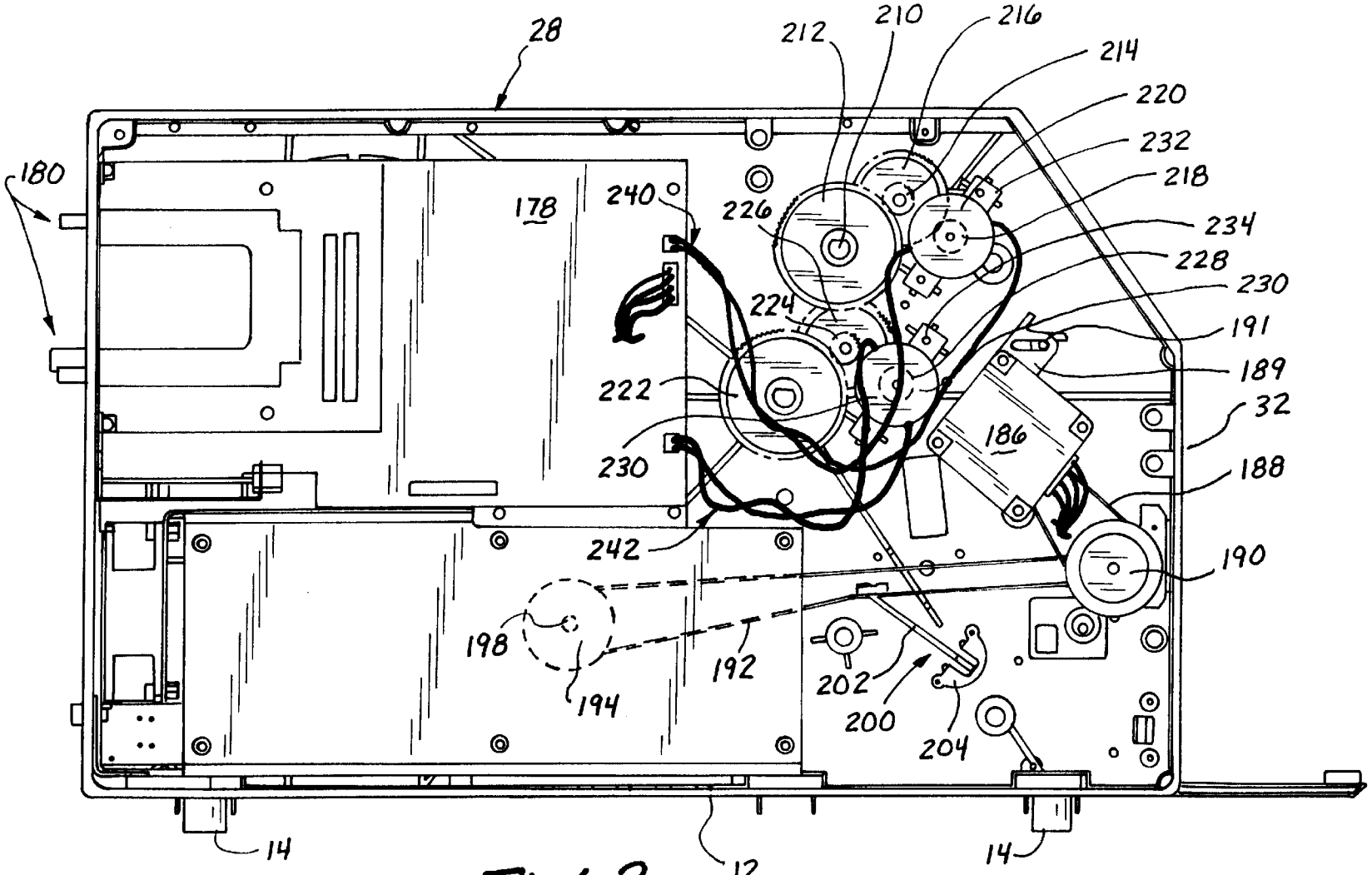
FIG. 3 shows a side elevation view of the drive system incorporating the media drive motor, D.C. motors for controlling the tension on the print ribbon as well as the gear train and electronic controls.

Looking more specifically at FIGS. 1 and 2, it can be seen that the thermal printer of this invention is shown in a perspective and side elevation view. The perspective view of FIG. 1 does not have any print ribbon connected to the respective spindles nor any media on spools as in FIG. 2. FIG. 2 more aptly shows the path of the media and the print ribbon which shall be detailed hereinafter.

Looking at the apparatus of FIG. 1, it can be seen that the thermal printer 10 has been shown with a case constituting a base portion 12 having legs 14 upon which it stands. The base portion 12 forms the base for back wall 16 and cast drive support wall 18 that is in the form of a casting. The casting of wall 18 is specifically utilized because of the rigidity which is desired for the supports of the drive mechanism. The casing is covered by a hinged lid that is not shown but wherein the hinges 20 attached to the lid are shown in FIG. 2.

A frontal access door 22 and top door 24 are shown as part of the lid and covering components.

Behind the wall 18 in the form of the casting is the control and mechanical drive for the thermal printer which are mounted therein. This is shown within a housing or casing 28 having an open portion 30 and front wall 32. The housing 28 can be of any suitable material so long as it covers and maintains the overall dust free environment and avoids contamination while at the same time protecting the gears and operators with respect to the gears.

In order to provide media to print on, a media support rod, bar or rack 36 has been provided to support a spool of media. The bar 36 is connected to the wall 18 in a rigid manner and is supported rigidly based upon the strength of the casting of the wall 18. In order to provide for media which is shown as a media roll or spool 38 on the bar 36, it is slipped over the bar. The roll or spool of media is supplied initially on a tube or cylinder 39. Afterwards a keeper 40 is placed in general alignment with the bar 36 and then moved vertically in order to lock the media roll 38 on the bar. The support of the media spool 38 is rigidified by a bossed portion 44 of the casting. The media can be a roll of paper, plastic, or tear off labels on an underlying sheet.

The media support rod 36 allows for the media to be transported by being pulled by and driven over a platen 48. The platen 48 can be a hard rigid elastomeric roller member which rotates and is driven by a drive mechanism within the casing 28. As the platen 48 rotates it pulls the media as can be seen in FIG. 2 in the form of a media strip 52 in a manner so that it is supported under tension with a pivotal foot 54.

The pivotal foot 54 is spring loaded by a coil spring on a rod 56 which allows for tensioning downwardly against the media strip 52 to keep it taut. The foot can be composed of any particular surface. In this particular case it has been shown as a convex elongated member. It has bracing ridges 58 therein in order to rigidify the foot 54 as it moves upwardly and downwardly for tensioning purposes around the axis of the pin or rod 56. This allows the media strip 52 to be held in a tightened or slightly stretched position as it passes thereunder. This is due to the spring load on the media strip 52 downwardly as it is paid off of the roll of media 38.

The media strip 52 passes toward the platen 48 and is pulled thereover by the platen 48 rotating. The media strip 52 can be printed with labels. Dislodging or stripping of the labels from the media strip 52 can be provided. These labels can be seen as the end printed product 60 moving outwardly away from the platen 48 after printing. In order to retract the underlying portion of the media 62 after the labels 60 have been removed therefrom, the remaining media underlying the labels 60 is coiled around a spindle 64.

The underlying or base media 62 is initially wrapped around the spindle 64 so that it can be pulled from the platen area over a surface 66. In order to secure the underlying base media 62, a spring loaded clip 68 seated in grooves of the spindle 64 is provided. The clip 68 also has a handle 70 which can withdraw the tines of the spring loaded clip from the groove of the spindle 64. This allows placement of the underlying base media 62 around the spindle. It is then secured by the tines 71 on either side of the spindle 64 within a groove of the spindle. Fundamentally the clip 68 is like a forked spring member having a handle 70 with tines 71 securing the media around the spindle 64.

In order to make an imprint upon the media 52, a thermal head 74 is provided. The thermal head 74 has a number of heating elements that can be upwards of three hundred dots per inch across the width. These dots provide the dot matrix printing by heating the print ribbon. The printing head is supported on a support 76 and extends backwardly on a bracket 78 attached to a pivotal member and pin 80. This allows the thermal head 74 to be lifted off on the pivoting bracket as it pivots around the pivotal support 80. Pivotal support 80 is in turn connected to a wall bracket of wall 18 in the form of bracket 82.

The thermal head 74 is locked in place by means of a latch lever 86 connected to a latch hook 90 that overlies a portion of the bracket 78 in order to hold it in place. The lever 86 with the latch hook 90 can be pivoted backwardly around a pivot 94 to allow upward movement of the head 74. In order to move the thermal head downwardly against the platen 48 a cam function is provided connected to lever 88.

The thermal head 74, as previously mentioned has a number of heating elements arrayed along its longitudinal length. The heating elements can number upwards of two to three hundred dots per inch. The engagement of the thermal head 74 against the platen 48 can be enhanced at the bite or intersection thereof by turning a knob 98 connected to two respective blocks 100 and 102. The two respective blocks 100 and 102 have cam members therein and are driven by a shaft 104 connected to the knob 98 in order to drive the blocks 100 and 102 into tighter engagement to push the print head 74 or loosen it against the platen 48.

The media spool 38 provides a strip 52 over the platen 48 and under the print head 74. This is in association with a print ribbon, or film 120 delivered from a print ribbon roll or spool 122. The print ribbon roll or spool 122 is supported on a tube or cylinder such as a cardboard tube 124 and in turn is emplaced on a spindle 126. The spindle 126 receives the spool of print ribbon and is held in place by a clip 128 which expands against the tube 124 of the roll 122 and in particularly cardboard tube 124 upon which the print ribbon is rolled.

The print ribbon strip 120 can vary in width such as by a four, six or eight inch width. The media strip 52 can also be of various size widths also.

The spindle 126 is driven by a D.C. motor connected to the spindle as will be expanded upon hereinafter and is held to a wall by a journaled bracket 130. The media strip 120 passes under an elongated semi-circular plate 134 which has a rounded configuration.

The plate 134 is fundamentally a pivotal gimbaled plate which can move around a pin 136 supported on a depending arm 137 as connected to a pivotal handle 138. The handle 138 is connected to the top of the bracket 82. This moves the pivot point of the gimbal plate 134 into various locations so that the print ribbon 120 passing thereover is supported at either edge around a pivotal point established by pin 136. In effect, the pivotal handle 138 connected to the pin 136 is received in a slot and allows the gimbal plate 134 to pivot around the axis thereof in the longitudinal position as the print ribbon 120 passes over the gimbal plate 134.

The gimbal plate 134 can be substituted for, or supplemented with a roller over which the print ribbon passes. The roller can be journaled from a roller journal 143 in order to eliminate striations, waves and inconsistencies of the plastic of the print ribbon. The inconsistencies can be in the lateral and longitudinal directions. Also, a pair of rollers on the front and back surface over which the print ribbon strip 120 passes can be utilized. This helps to eliminate inconsistencies that have been set into the print ribbon as it feeds off of the spool 122.

The adjustment of the gimbal pin 136 for the gimbal element 134 with the handle 138 can be made along a given path and indexed as can be seen with index scale or marks 140. This is done by moving laterally the pivot pin 136 to a particular point for maintaining balance of the width of the print ribbon moving thereover. Furthermore, the adjustment scale or index 140 by moving the handle 138 can accommodate variously sized widths such as four, six and eight inches of print ribbon strips 120. Thus it has a dual function of maintaining the, proper respective tension across the width of the print ribbon 120 as well as providing for adjustment of variously sized print ribbon from the spool 122.

The print ribbon 120 as it moves across the gimbal is then introduced and brought into contact with the media strip 52 between the print head 74 and the platen 48. The print head 74 is electrically driven by internal drivers that are included in the print head to create a degree of heated resistance for imparting selective dots of the material on the print ribbon strip 120 to the underlying media strip 52. Labels, such as labels 60 are then stripped off and allowed to be fed outwardly while the remaining portion of the media strip shown as media strip 52 is wound around the spindle 64. Spindle 64 is driven by a belt drive on the other side of wall 18 as will be expanded upon hereinafter.

After the print ribbon 120 has passed between the print head 74 and platen 48, it moves upwardly over the bracket 76 into contact with another gimbal bar 150. This gimbal bar 150 is controlled in its lateral movement in the direction of the print ribbon by means of a pin 152 attached to a handle 154. The bar 150 can be adjusted so it can accommodate the lateral movement of the print ribbon 120 web passing thereover. The bar can be substituted with a roller that is supported in bearings at its ends and gimbaled to provide uniform support to the print ribbon web 120.

This handle adjustment 154 can be seen with an index 158 that allows for the various widths of print ribbon 120 as well as adjustment of the respective ends of the bar 150. This accommodates the movement of the print ribbon strip 120. Thus, a degree of tautness and consistency of the print ribbon is maintained over the gimbal bar 150 as it is wound on a take-up roller or spindle 162. The take-up roller or spindle 162 can be seen with a tube of cardboard 164 upon which the print ribbon 120 is wound in the rewind condition. The print ribbon 120 can be emplaced in any manner around the spindle 162 and secured by a clip 165 holding the cardboard tube 164. As the take-up spindle 162 rotated it develops a wound spool of used print ribbon 120 in the form of a spool 167 that is shown developing as winding is taking place.

As an aside, it is generally customary to remove the cardboard tube from the feed roll such as cardboard tube 124 and place it on the take-up spindle 162 after the roll 122 has has been fully expended. This allows for continuity and usage of the cardboard tube in developing the take-up spool 167.

The spindle 162 is supported on a journaled bracket 172 connected to the wall 18 to allow rotational movement by means of a D.C. motor as will be expanded upon hereinafter.

Looking more specifically at the opposite side of the wall 18 within the cabinet 28, it can be seen that a controller card 178 having the controls as well as the power supply and other means for controlling the thermal printer has been shown. This controller card 178 is connected by various terminals such as terminal areas 180. Terminal areas 180 connect the controller card 178 to a host such as a host computer or other control means driving and inputing the information to the memory and processor of the controller card. The host can integrate all the functions of the printer into a network and provide a report of the thermal printer status to the network for updated monitoring as to printer ribbon amounts and whether it is out or broken.

The thermal printer can also utilize a control system with a pre-programmed printing memory established through an input panel. This has been shown as input panel 182 having on/off and other programmable features programmable by buttons 184. However, in most cases the thermal printer is connected for sophisticated alpha numeric output and bar codes to a host computer or controller with respect to an output to the input of the terminals 180. It should be understood that various controls and drive systems can be utilized for the motors of this invention as well as the input to the drivers of the thermal head 74.

Looking more particularly at the drive system of the thermal printer 10, it can be seen that a two phased stepper motor 186, which can of any other phase known to one skilled in the art has been shown. Stepper motor 186 controls the platen 48 by means of a belt 188. The belt 188 can be adjusted by a tensioning means 189 which is adjusted by means of a screw setting 191 in a slot. The belt 188 is connected to a pulley or sheave drive 190. The sheave 190 drive shaft is connected to a second belt 192 which is in turn connected to a sheave or pulley 194 that connects to the underlying media strip 62 take-up spindle or roller 64. This can be accomplished by a shaft 198 passing through the sheave or pulley 194 interconnecting the roller 64 at the shaft which it is journaled on.

In order to hold the belt 192 in tension, a tensioner 200 is shown comprising a tensioner arm 202 connected to or molded with a bracket 204 which is in turn mounted to the wall 18 by screws or other fastener means. The tensioner 200 is biased for upward pressure against the belt 192, but can be used to tension it in either direction (i.e. upwardly or downwardly).

The respective shaft to the take-up spindle 162 or spool is shown as shaft 210. Shaft 210 passes through the wall 18 and is connected to the take-up spindle 162 on one end and to a gear 212 on the other end. Gear 212 is connected to a pinion 214 which is in turn connected to a gear 216 driven by a gear 218 of a D.C. motor 220. The D.C. motor can be a D.C. brush motor, or a brushless motor. Such brushless motors have controls to cause them to function with the appearance of a two terminal motor.

The supply spool spindle 126 on which the print ribbon spool 122 is mounted has a common shaft with a gear 222 that is shown with the common shaft passing through to the spindle. This gear 222 interfaces with a pinion 224 that is connected to a gear 226. Gear 226 is in turn connected to a gear 228 that is connected to a brush or brushless D.C. motor 230.

Both brushless or brush motors 220 and 230 are mounted by means of brackets respectively 232 and 234. These respective brackets allow adjustment of the D.C. motors 220 and 230.

D.C. motor 220 is connected to the controller and driver 178 by means of two lines 240 while D.C. motor 230 is connected thereto by lines 242. These two respective lines 240 and 242 allow for the driving of the D.C. motors on an incremental basis. They also receive feed back therefrom as to the BEMF established when the D.C. motors are moving. This BEMF is significant and substantial in the control of the D.C. motors 220 and 230. The control of the D.C. motors places tension on the print ribbon 120 as it is taken up on spindle 162 and paid out from spindle 126. Thus as spools 122 and 167 are respectively paid out and developed the torque on the spools and attendant tension of the print ribbon 120 is compensated. This allows for tension and even movement of the print ribbon 120 as the spools 122 and 167 are respectively decreasing and increasing in their radius, mass, and relative radial velocity.

OPERATION AND CONTROLS

Figure 4:
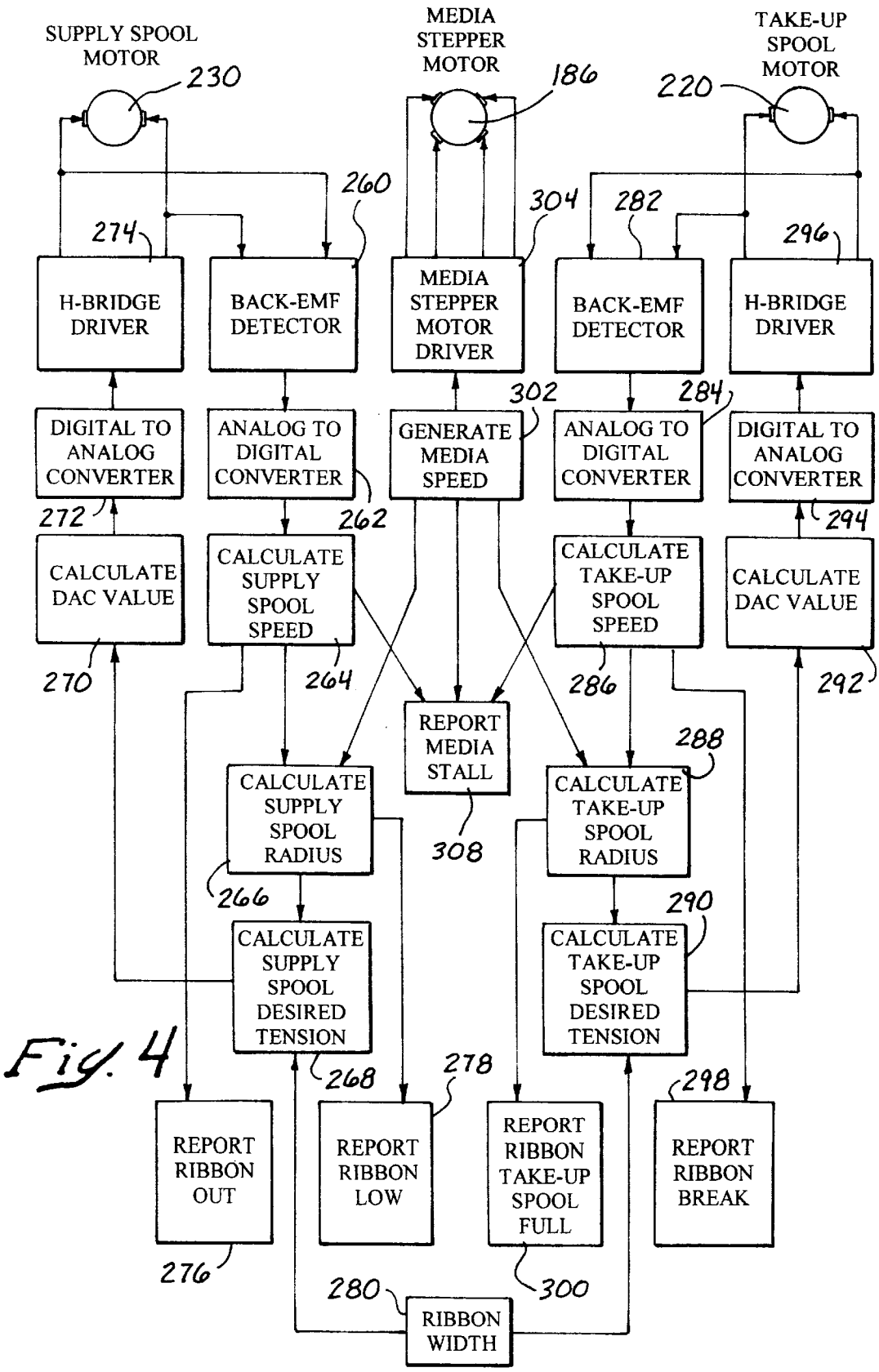
FIG. 4 shows a block diagram of the system and the way it functions with regard to the controls.
Figure 5:
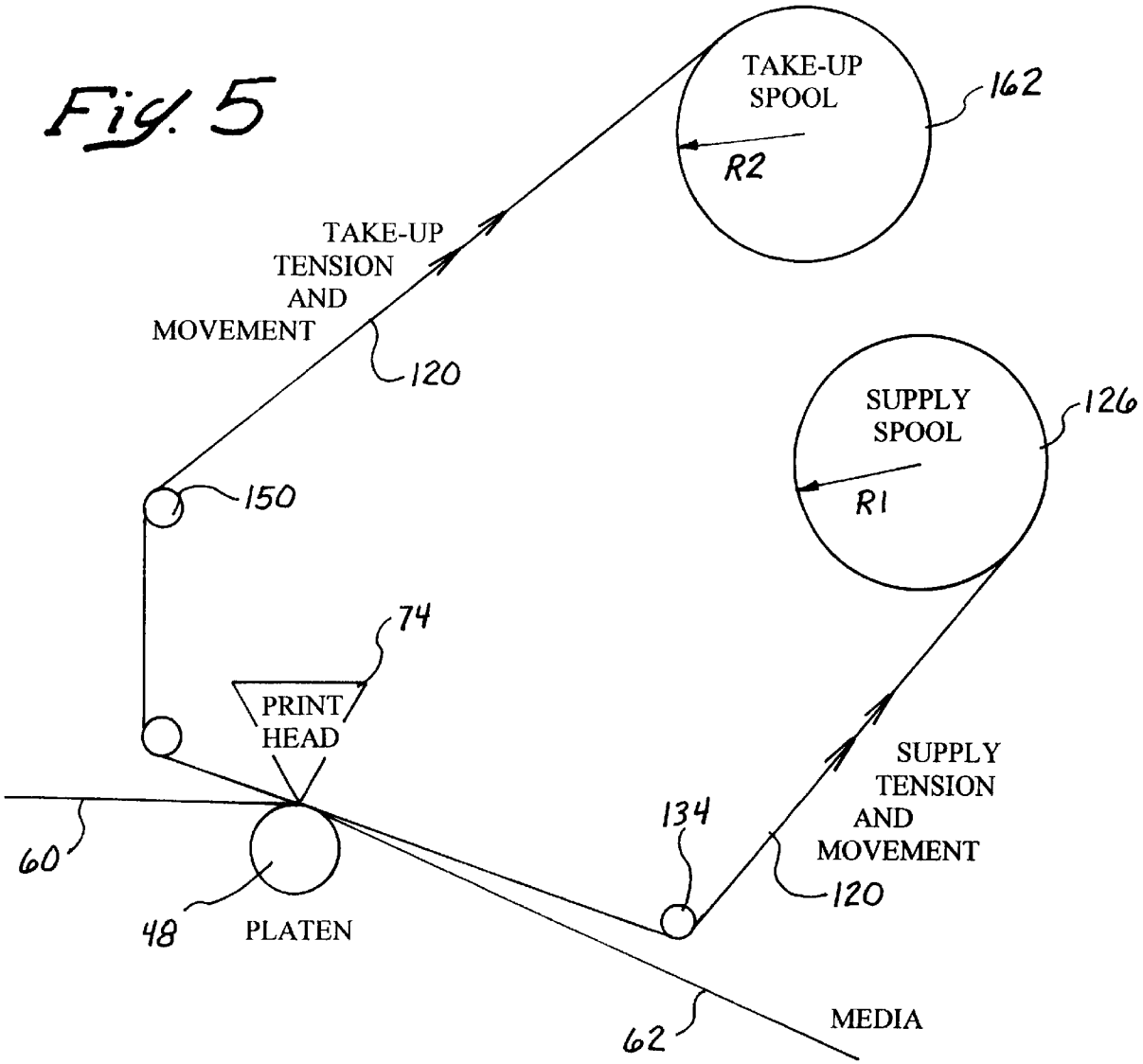
FIG. 5 shows a chematic view of the print ribbon take-up spool and supply spool with the media passing over the print head and platen.
Figure 6:
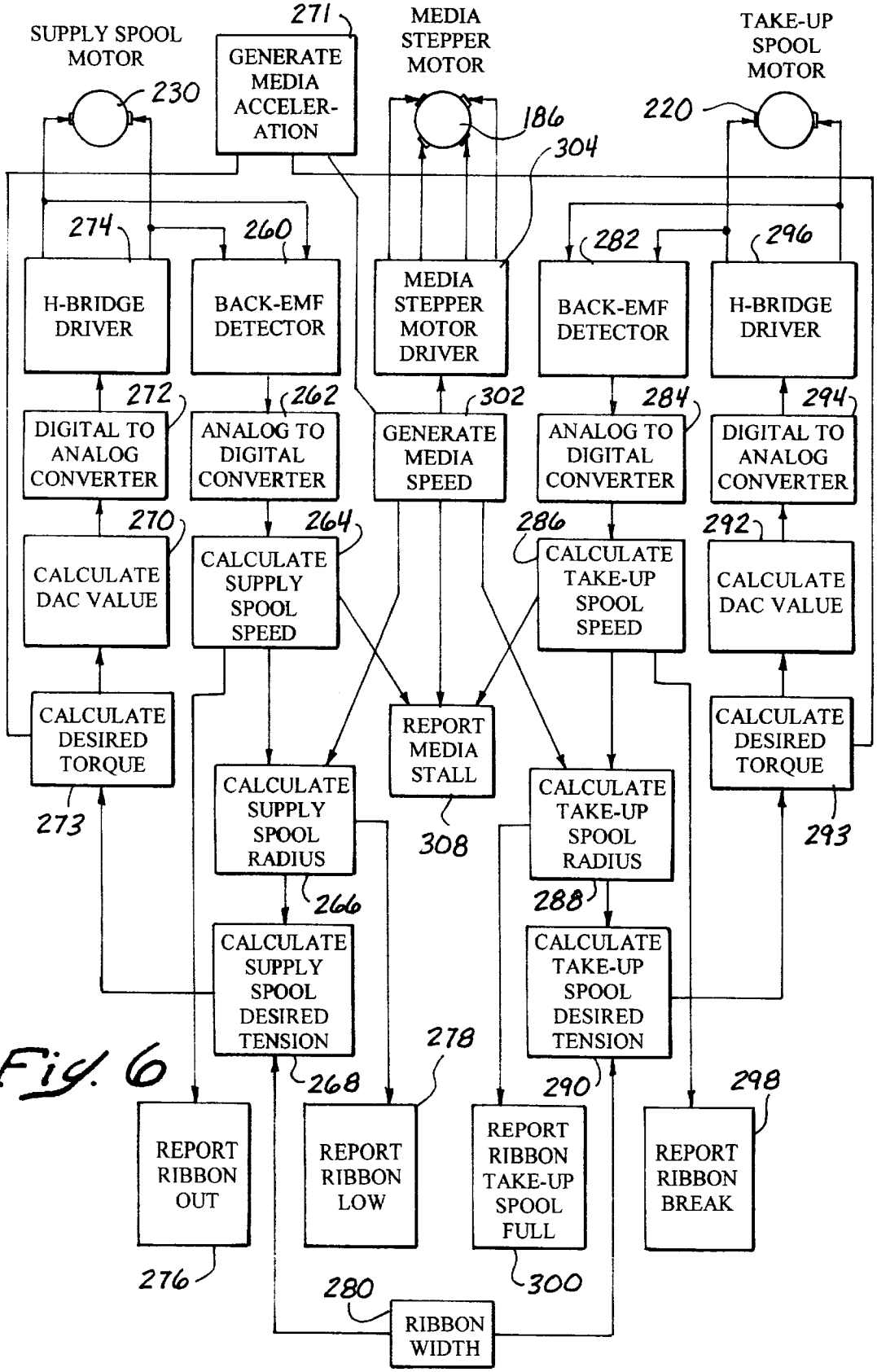
FIG. 6 shows a block diagram of the system and the way it functions to take into account the torque which is required.

Looking at FIGS. 4 and 6 which schematically show the controls of the apparatus and electrical and electronic devices previously set forth, it can be seen that the respective print ribbon supply spool 122 D.C. motor 230, media stepper motor 186, and take-up print ribbon spool 167 D.C. motor 220 have been shown schematically. The respective inputs to the coils of the motors have been shown. These coils are in turn connected to the controller box 178. This has been previously set forth as providing the controls as well as the power and other functions necessary to run the thermal printer based upon the information input at terminals 180.

The supply spool D.C. motor 230 is connected to the print ribbon supply spindle 126 which has the spool 122 thereon. This connection is through gears 222 through 228. This gear drive with the motor 230 is used to create tension on the ribbon 120 in the area between the supply spool 122 and the platen 48.

A BEMF detector 260 connected to motor 230 for the ribbon supply spool 122 movement and velocity is shown. The BEMF detector 260 is an electronic circuit that isolates the backwards electromotive force or BEMF of the supply spool D.C. motor 230. The detector 260 sends out a pure analog signal. The BEMF is a voltage that is generated by the motor 230 and is proportional to the motor velocity. By measuring this voltage, the motor 230 velocity, which is fundamentally a rate of movement, through the cutting of flux lines within the coils can be calculated.

An analog to digital convertor (ADC) 262 reads the analog signal that is the output of the BEMF detector 260 and converts to a digital number. This number can be read by a micro-processor within the controller 178. A calculation of the supply spindle 126 speed on which spool 122 is mounted, is provided by a micro-processor. The micro-processor reads the number that is output by the supply spool ADC 262 and multiplied by a constant to obtain the supply spool 126 speed. From this, the supply spool 126 radius can be calculated through the micro-processor which reads the value that was calculated from the supply spool speed 264. The value of the media strip 52 speed 302 is then used with the supply spool speed 264 to calculate the radius of the supply spool 122.

The print ribbon supply spool 122 tension is then calculated by the micro-processor reading the value that was calculated from the spool radius 266. The value of the ribbon width 280 is used to calculate the desired supply spool tension 268. As can be understood, the width of the print ribbon 120 web must be taken into account in order to establish the tension necessary because as the width increases, greater inertia and drag is encountered through the system. This is input as print ribbon width 280. This not only applies to the mass on the spool 122, but also the material moving over the platen 48 and over the other various components.

The micro-processor in the controller 178 will read the value that was calculated for the supply spool tension 268 and multiply it by a constant to get the correct value needed by the supply spool digital to analog convertor (DAC) 272. The supply spool DAC 272 receives the digital value 270 calculated by the micro-processor and converts it to an analog voltage. This analog voltage from the converter 272 is used to control the required current through the H bridge driver 274 for the D.C. motor 230. When referring to tension 268 it also refers to movement in general as well as tension to determining placement and status of the print ribbon. The H bridge driver can be substituted by any motor driver such as a power operational amplifier (Op Amp) and/or a three phase bridge. The motor can be driven both by analog input and digital input.

Inasmuch as the spool 122 and movement of print ribbon 120 has inherent mass and inertia this should be taken into consideration as well as the velocity or supply spool speed 264. In order to do this the various functions of the system are calculated including the inertia through the gears and drive. This is input into memory of the controller 178. The acceleration of the media strip 52 is provided and input at input 271. This serves to supply along with the other components and calculations a desired torque 273 that motor 230 should provide. By calculating this torque, the energy required of motor 230 is provided in order to maintain desired tension on the print ribbon 120.

A reason to calculate the inertia of the ribbon and the ribbon drive mechanisms is to calculate the proper motor torque during the ribbon acceleration and deceleration. This allows a constant tension on the ribbon to be maintained. The ability to maintain constant tension during acceleration and deceleration is a very important function to provide consistent movement and printing.

In order to report when the print ribbon 120 is out, the micro-processor and controller 178 monitors the supply spool speed 264. If this speed 264 becomes large in the negative direction the micro-processor of controller 178 reports that the ribbon is out by a ribbon out message 276. In order to provide information as to when the print ribbon 120 is low, the micro-processor of controller 178 monitors the supply spool radius 266. If radius 266 is close to the radius of the cardboard tube 124 which the ribbon 120 is wrapped around, it reports a ribbon low message.

The width of the ribbon as previously stated creates a matter of inertia as well as drag. Thus, an input is entered by the operator on the panel 182. This width is then readable by the micro-processor in the controller 178 which is then utilized to calculate the supply spool tension 268.

The take-up spool D.C. motor 220 is connected to the ribbon take-up spindle 162 through gears 212 through 218. The D.C. motor 220 is used to create tension on the ribbon 120 in the area between the take-up spool 162 and the platen 48. This function takes place as a spool 167 is developed on the cardboard tube 164 mounted on the spindle 162.

A BEMF detector 282 for the ribbon take-up spool 167 is provided as a circuit that isolates the BEMF of the take-up spool D.C. motor 220. This sends out an analog signal based upon the BEMF generated by the rotation of the motor 220 which is in turn proportional to the motor velocity. By measuring this voltage of the motor 220, velocity can be calculated due to the fact that the voltage is fundamentally the rate of flux lines being cut through the rotation of the motor coils.

An analog to digital convertor (ADC) 284 reads the analog signal that is output by the BEMF detector 282 of the ribbon take-up spool D.C. motor 220. The ADC converts it to a digital number that can be read by the micro-processor of controller 178. The micro-processor will read the number that is the output of the take-up spool ADC 284 and multiply it by a constant to obtain the take-up spool 167 speed. The micro-processor and controller 178 will then read the value that was calculated for the take-up spool speed 286 and the value of the media speed 302 and use them to calculate the radius of the take-up spool 162.

Based upon the foregoing, a calculation of the take-up spool tension 290 is utilized by the controller 178 reading the value that was calculated for the spool radius 288. The value of the ribbon width 280 is then used to calculate the desired take-up spool 162 tension for the amount of torque applied thereto in the form of the input to the take-up spool 167 D.C. motor 220.

In order to take into consideration the torque required on the spool 167 developing on the spindle 162 as well as the gear drive and system a desired torque calculation is provided for the D.C. motor 220. This desired torque is calculated as an input to a calculation of the DAC value 292.

A reason to calculate the inertia of the ribbon and the ribbon drive mechanisms is to calculate the proper motor torque during the ribbon acceleration and deceleration. This allows a constant tension on the ribbon to be maintained. The ability to maintain constant tension during acceleration and deceleration is a very important function to provide consistent movement and printing.

The micro-processor and the controller 178 reads the value that was calculated for the take-up spool tension 290 and multiplies it by a constant to obtain the correct value needed by the take-up spool 167 DAC 294 with the desired torque 293. Supply spool tension 290 as in other cases herein can also be analogous to movement and position of the ribbon 120. For instance when a ribbon break occurs the tension naturally falls off as well as ribbon movement. This take-up spool 167 DAC 294 receives the digital value calculated by the micro-processor namely value 292 and converts it to an analog voltage. An H bridge driver 296 connected to the motor 220 receives the analog voltage from the take-up spool 167 DAC 294. This analog voltage is used to provide the desired amount of current to flow through the H bridge driver 296 to power the D.C. motor 220. The H bridge driver can be substituted by any motor driver such as a power operational amplifier (Op Amp) and/or a three phase bridge. The motor can be driven both by analog input and digital input.

In order to ascertain when a ribbon is broken, the micro-processor in the controller 178 monitors the take-up spool speed 286. If this speed becomes large in the positive direction the micro-processor reports a ribbon break message 298.

The micro-processor and controller 178 also monitors the take-up spool 167 radius 288 as it develops on the spindle 162. If the calculation 288 is too large, it reports a take-up spool full message. In other words, the spool 167 has been increased to the extent where the printer should be stopped and the take-up spool removed for further winding thereon.

The media 52 speed is important in that it generates the speed available to all other routines. It also provides the speed to the media stepper motor driver 304. The stepper motor driver 304 is fundamentally an electrical circuit that applies power to the stepper motor 186. This speed is received from the generation of the media speed calculation 302.

It is important to note any media 52 stall. Therefor, controller 178 monitors the supply spool speed 264, the take-up spool speed 286 and the generation of media speed 302. If the media speed is not zero, and the supply speed 264 and the take-up spool speed 286 are zero, then a media stall will be reported. This is then acted upon by operator input or automatic stoppage of the thermal printer.

One of the reasons to detect, monitor, and provide status as to the ribbon out, ribbon broken, ribbon and media stall, ribbon low, take-up spool full and ribbon width is to send the information back to the user that may not be in view of the printer. The printer is able to send the information back using a multiple of methods including but not limited to the front panel of the printer, bi-directional parallel port, serial port, and Ethernet port, etc.

In essence all the reports as to ribbon amounts etc. can be provided to a controller as shown, and then to a host or other reporting system. The display can be an analog needle like, or bar like display. It also allows a ribbon remaining gauge without any additional hardware, the value of the ribbon remaining, and the ribbon low, ribbon out ribbon/media stall, take-up full and/or the ribbon being broken as a separate display.

The various reports and controls take into consideration the inertia of the system. This includes the dynamic changes in inertia based upon amounts of ribbon 122 and 167 as well as the mechanism.

The inertia can also be used to automatically detect the ribbon width. The ribbon width is calculated by measuring the ribbon radii of both the supply and take-up spools 122 and 167 using the BEMF sensors. After the ribbon radii on spools 122 and 167 are known then the spool with the largest radius is then driven in the reverse direction (the direction that creates slack) from a full stop with a constant torque, and the acceleration of the ribbon motor is measured using the BEMF sensor after a fixed period of time. By knowing the radius of the spool, the density of the ribbon and the inertia of the spool the ribbon width is then calculated.

As can be seen from the foregoing, the control of the supply spool D.C. motor 230 and the take-up spool D.C. motor 220 are important to apply proper tension across the print head 74 and platen 48. By applying proper tension to the print ribbon 120, wrinkles and attendant imperfections in printing are diminished. This provides for a fine high quality discrete printing function on the media 52 that results in a label 60 or other printout of high accuracy. Accordingly, this invention should be read as a substantial step over the art in the control and handling of print ribbon and media for a thermal printer.

What is claimed is:

1. A thermal printer comprising:

support for a spool of media;

a platen on which said media can move;

a print head in association with said platen for printing on said media;

a rotatable print ribbon supply spindle for a print ribbon supply spool;

a rotatable take-up spindle for taking up print ribbon and forming a take-up spool from said supply spool as it moves in association with said media between said platen and print head;

a motor connected to said print ribbon supply spindle;

a motor connected to said take-up spindle; and, a control means to provide movement of said print ribbon by controlling the movement of said motors, wherein said control means calculates a desired tension on said print ribbon from said supply spindle, and tension on print ribbon to said take-up spindle and adjusts their respective velocities.

2. The thermal printer as claimed in claim 1 further comprising:

a rotatable platen which moves media from said media support.

3. The thermal printer as claimed in claim 1 further comprising:

a rotatable spindle with a drive means to retract expended media after it has been printed.

4. The thermal printer as claimed in claim 1 further comprising:

said control means calculates a desired tension of the print ribbon on said print ribbon supply spool and said take-up spool and adjusts their respective motor torques.

5. The thermal printer as claimed in claim 1 wherein:

said control means calculates a desired movement of said supply spool based upon the Back EMF (BEMF) of the motor connected thereto.

6. The thermal printer as claimed in claim 1 further comprising:

said control means calculates the desired tension of the print ribbon being wound on said take-up spool based upon the BEMF of the motor connected thereto.

7. The thermal printer as claimed in claim 1 wherein:

said control means calculates desired supply spool and take-up spool print ribbon tension based respectively on the supply spool and take-up spool radius.

8. The thermal printer as claimed in claim 1 further comprising:

means to input ribbon width; and, wherein said control means provides print ribbon tension by said motors based in part on said ribbon width.

9. The thermal printer as claimed in claim 1 further comprising:

means to detect the BEMF of said supply spindle motor and take-up spindle motor; and, wherein said control means calculates the supply spool speed and take-up spool speed from the BEMF respectively of each motor.

10. The thermal printer as claimed in claim 1 further comprising:

said control means calculates the supply spool radius and take-up spool radius based upon the BEMF of the supply spindle motor and the take-up spindle motor.

11. A drive for a thermal printer print ribbon for printing on media comprising:

a supply spindle for supporting a supply spool of print ribbon;

a take-up spindle for supporting a take-up spool for print ribbon;

a motor for driving said supply spindle;

a motor for driving said take-up spindle;

means for detecting the Back EMF (BEMF) on each motor; and, a controller for calculating the movement of each motor based upon the BEMF and controlling the print ribbon between said spools based upon the velocity.

12. The drive as claimed in claim 11 wherein:

said controller calculates the respective spindle speeds by converting the BEMF of each motor to a digital value and calculates the spool radius of each spool to supply an input to each motor based upon the desired torque of each motor for the desired tension of the print ribbon.

13. The drive as claimed in claim 11 further comprising:

means to input the ribbon width to said controller to compensate for inertia of the ribbon and spools.

14. The drive as claimed in claim 11 further comprising:

means to calculate a digital value based upon each spool radius; and, inputing each digital value to a digital to analog converter and using said converted values to drive said supply spindle motor and take-up spindle motor.

15. The drive as claimed in claim 11 further comprising:

a rotating platen to move media which is to be printed upon by the print ribbon; and, means in said controller to move said platen at a speed to move said media in synchronization with said print ribbon.

16. The drive as claimed in claim 15 further comprising:

means in said controller to calculate the torque required of each of said motors to maintain the print ribbon in proper tension across the platen; and, means to monitor and provide status of the print ribbon.

17. The drive as claimed in claim 11 further comprising:

said means for calculating torque includes a calculation of radial velocity of each spool mounted on each spindle.

18. The drive as claimed in claim 11 further comprising:

means for calculating the torque on each spindle including a calculation of the inertia of the print ribbon on each spool.

19. The drive as claimed in claim 11 wherein:

said controller controls the print ribbon tension between said spools to compensate for acceleration and deceleration thereof.

20. The drive as claimed in claim 11 further comprising:

means within said controller to calculate inertia of at least the supply or take-up spool to calculate the width of the ribbon.

21. A thermal printer comprising:

means for supplying media;

means for taking up media that has been printed upon;

a rotatable platen on which said media passes and which causes said media to be moved for printing purposes;

a thermal printer head;

a supply spindle for supplying print ribbon from a supply spool of print ribbon mounted thereon;

a take-up spindle for taking up print ribbon which has been used for printing said media and on which said print ribbon can be wound as a take-up spool;

a supply spindle motor connected to said supply spindle;

a take-up spindle motor connected to said take-up spindle;

a controller connected to said motors;

means for detecting the Back EMF (BEMF) of the supply spindle motor and take-up spindle motor; and, means in said controller for controlling and monitoring the print ribbon based upon the BEMF.

22. The thermal printer as claimed in claim 21 wherein:

said controller calculates the radius of print ribbon on the supply spool and take-up spools and their respective radial velocity.

23. The thermal printer as claimed in claim 21 wherein:

the BEMF of said supply and take-up spindle motors is converted to a digital value and then used to calculate the respective spindle speeds and radius of print ribbon of each spool on its respective spindle; and, the value of a desired print ribbon tension based upon spool radius is calculated to form a drive signal to each respective motor.

24. The thermal printer as claimed in claim 21 wherein:

the BEMF provides print ribbon status information for said controller to monitor.

25. The thermal printer as claimed in claim 21 further comprising:

means for reporting a print ribbon out condition as a function of supply spindle speed.

26. The thermal printer as claimed in claim 21 further comprising:

means for reporting a print ribbon low condition as a function of the supply spool radius which has been calculated from the supply spindle speed.

27. The thermal printer as claimed in claim 21 further comprising:

means for reporting the take-up spool as being full as a function of the take-up spool radius.

28. The thermal printer as claimed in claim 21 further comprising:

means for reporting a print ribbon break as a function of the take-up spindle speed.

29. A method of controlling a thermal printer comprising:

providing a supply spool of print ribbon mounted on a supply spindle;

providing a take-up spindle for print ribbon on which a spool of print ribbon can be wound;

providing a motor to said supply spindle and a motor to said take-up spindle; and, controlling and monitoring the print ribbon by the Back EMF (BEMF) of each motor.

30. The method as claimed in claim 29 further comprising:

calculating the supply spindle radial velocity and take-up spindle radial velocity and controlling a drive signal to each motor based thereon.

31. The method as claimed in claim 29 further comprising:

calculating the supply spool and take-up spool radius based upon their respective radial velocities;

calculating the respective desired supply spool ribbon tension and take-up ribbon tension; and, inputing a drive signal to said supply spindle take-up motor and take-up spindle motor based on the calculated tension desired and converting it to an analog drive signal to each respective motor.

32. The method as claimed in claim 29 further comprising:

monitoring print ribbon out, print ribbon low, print ribbon take-up spool full and print ribbon broken conditions based on said BEMF of each motor.

33. The method as claimed in claim 29 further comprising:

controlling the print ribbon through the BEMF by making dynamic changes in acceleration and deceleration in order to maintain desired tension on the print ribbon.

34. The method as claimed in claim 29 further comprising:

determining the inertia of the respective supply spool of print ribbon, or print ribbon being wound from which a calculation of width of the print ribbon can be reported.

35. A method of thermal printing comprising:

providing a spool of media that is to be printed upon;

moving said media over a rotating platen;

supplying a spool of print ribbon from a supply spool;

moving said print ribbon over said platen and said media for printing thereon;

providing a take-up spool for taking up the print ribbon after printing has taken place;

driving said supply spool with a D.C. motor;

driving said take-up spool with a D.C. motor; and, controlling said supply spool D.C. motor and take-up spool D.C. motor for print ribbon movement between them by utilizing the Back EMF (BEMF) signals of said motors.

36. The method as claimed in claim 35 further comprising:

rotating said platen with media thereon by means of a stepper motor.

37. The method as claimed in claim 35 further comprising:

converting the BEMF signals from said supply spool motor and take-up spool motor into digital signals;

calculating their respective spool speeds based upon said digital signals;

calculating the respective spool radii based upon the respective spool speeds;

calculating the desired spool speed for the print ribbon; and, using the desired movement as calculated to provide a converted digital to analog signal to drive the respective supply spool D.C. motor and take-up spool D.C. motor.

38. The method as claimed in claim 37 further comprising:

providing a ribbon out report based upon the calculated speed of the supply spool.

39. The method as claimed in claim 37 further comprising:

reporting the status of the print ribbon to a host.

40. The method as claimed in claim 37 further comprising:

reporting the ribbon take-up spool as being full based upon the calculation of the take-up spool radius.

41. The method as claimed in claim 40 further comprising:

providing a ribbon break signal based upon the calculation of the take-up spool velocity.

* * * * *